United States Patent [19]

Thurston et al.

[11] 4,391,655

[45] Jul. 5, 1983

[54] TREATMENT FOR THE ALLEVIATION OF HIGH TEMPERATURE OXIDATION OF ALUMINUM

[75] Inventors: Michael E. Thurston; William A. Cassada, III; Daniel J. Schardein, all of Richmond, Va.

[73] Assignee: Reynolds Metals Company, Richmond, Va.

[21] Appl. No.: 306,484

[22] Filed: Sep. 28, 1981

[51] Int. Cl.[3] ..... C21D 1/44

[52] U.S. Cl. ..... 148/20.6; 148/28; 148/6.27

[58] Field of Search ..... 148/13, 13.1, 20.3, 148/20.6, 28, 12.7 A, 6.27

[56] References Cited

U.S. PATENT DOCUMENTS

| | | | |
|---|---|---|---|
| 1,130,196 | 3/1915 | Pucillo | 148/6.27 |
| 2,092,035 | 9/1937 | Stroup | 148/20.3 |
| 2,285,468 | 6/1942 | Slunder | 148/6.27 |
| 2,885,313 | 5/1959 | Milliken | 148/13.1 |
| 2,885,315 | 5/1959 | Milliken | 148/20.3 |
| 2,885,316 | 5/1959 | Milliken | 148/20.3 |
| 3,819,424 | 6/1974 | Russell et al. | 148/6.27 |
| 4,061,830 | 12/1977 | Greenberg | 148/6.27 |

*Primary Examiner*—John P. Sheehan

*Attorney, Agent, or Firm*—Alan T. McDonald

[57] ABSTRACT

High Temperature Oxidation (HTO) of aluminum subjected to heat treatment is controlled by exposing the aluminum surface to a metal chloride prior to heat treatment. Transition metal chlorides are preferred for such treatment.

12 Claims, No Drawings

TREATMENT FOR THE ALLEVIATION OF HIGH TEMPERATURE OXIDATION OF ALUMINUM

BACKGROUND OF THE INVENTION

1. Field of the Invention

The present invention relates to the control or elimination of High Temperature Oxidation (HTO) of aluminum surfaces, especially those of alloys which contain magnesium, when such surfaces are exposed to heat treatment.

2. Description of the Prior Art

High temperature oxidation (HTO) has long been a problem in the aluminum industry which extends itself into a number of areas such as vacuum brazing and casting. In the bright anodic finishing of automobile bumpers, very mild HTO can cause very severe problems in the specularity and image quality of the surface.

It is theorized, that during solution heat-treatment, hydrated oxides on the metal surface break down, releasing nascent hydrogen. The hydrogen diffuses into the metal surface and coalesces into bubbles of hydrogen gas. When bright finished, the bubbles of gas are exposed producing an unacceptable appearance.

Methods which have been used to reduce or eliminate HTO include dry inoculation of furnace atmospheres with fluoroborate compounds and removal of the surface by mechanical or chemical means prior to solution heat-treatment. The former furnace innoculation methods are described in detail in U.S. Pat. Nos. 2,885,313; 2,885,315 and 2,885,316. Although such methods are very useful in controlling HTO they pose obvious environmental, materials handling and cost problems because of the requirement of filling the entire internal volume of a furnace with a vaporized fluorinated compound.

Japanese Patent Application No. 50014-1979 suggest the use of certain sulfate and fluoride compounds to inhibit blistering of aluminum materials prior to heat treatment.

Accordingly, research has continued for more advantageous methods of controlling or eliminating HTO.

SUMMARY OF THE INVENTION

According to the present invention HTO is eliminated by exposing the surface of the aluminum material to be subsequently heat treated to an aqueous solution of a transition metal chloride or mixtures thereof prior to heat treatment. Such surface exposure may be obtained by immersion, roller coating, spraying or other technique of application (without wiping).

DETAILED DESCRIPTION OF THE INVENTION

As described hereinabove, the elimination of HTO by a relatively simple commercially applicable technique has long been a goal in the aluminum industry, even though commercially practiced operations such as the fluoroborate process have been practiced with some success for years. The process of the present invention involves, in its simplest and most basic application, the exposure, of the aluminum surface to be heated to an aqueous solution of a metal chloride. As will be demonstrated in the examples below, transition metal chlorides, eg. zinc, nickel, copper, cobalt and iron chlorides have been found most useful. According to a preferred embodiment iron chloride is used because of its low cost, excellent results and freedom from environmental problems.

Although as will be evident from the examples presented hereinafter, a number of variables play some role in the successful practice of the invention, the process of the present invention will provide successful results when the pH of the aqueous metal chloride solution ranges from about 0.5 to about 2, the treatment time varies from about 1 to about 300 seconds and the metal chloride salt concentration ranges from about 0.5 to about 25%. As would be expected, generally, the lower the salt concentration the higher the pH, and the longer the immersion or exposure time required. Optimum results (i.e. lowest exposure time) appear when the metal chloride concentration is between about 3 and about 10% by weight and the pH lies between about 1 and 1.5.

As will be evident from the data presented herein, the treated surface should not be rinsed or wiped subsequent to metal chloride treatment and before heat treatment. Such rinsing or wiping partially removes the metal chloride protective layer thereby derogating from the desirable results achievable with the technique.

The following examples will serve to better demonstrate the useful scope and practice of the process of the present invention.

In each of the examples a uniform technique was adopted to determine the ability of any given treatment to reduce HTO. According to this uniform method an alloy simply was treated with the test solution according to the specified conditions, heated treated as quickly as practicable, bright anodized according to conventional techniques for aluminum to a bright finish and then tested by determination of the C.E.J. Glossmeter Quotient. This test measures the image quality of the surface under evaluation and compares it to the image quality of a standard silver mirror whose image quality is assigned a value of 100. In this testing the fluoroborate control (i.e. the product which has demonstrated commercial acceptability in the past) yielded a C.E.J. Quotient of 92–96. Thus, for purposes of this invention, any treatment which demonstrated a C.E.J. Quotient of 90 or more is considered satisfactory.

In each of the examples the surface of the aluminum to be heat treated was exposed to the solution under test by immersion, spraying or roller coating, as indicated, for the period shown, and C.E.J. Glossmeter Quotient reported. Results for controls: (1) HCL treatment; (2) standard fluoroborate treatment; and (3) material as received i.e. heat treated with no special control applied were recorded.

Since almost all aluminum surfaces which are subjected to heat treatment carry at least some traces of lubricant, it is generally necessary to include a small amount (i.e. about 0.1%) of a surfactant in the aqueous metal chloride solution. Although any surfactant which does not react with the metal chloride or otherwise unfavorably affect the aluminum or the handling apparatus can be used, particularly good results have been attained using acetolenic glycols. The surfactant need not be used if the aluminum surface is cleaned sufficiently before application of the aqueous solution that uniform wetting is not a problem.

EXAMPLE 1

Table No. 1 shows the results of testing as described hereinabove. In each case, about 0.1% by volume of surfactant was added to insure proper wetting of the metal surface. From this Table No. 1, it is apparent that both immersion and spray application of the ferric chloride provided results equal to and in some cases superior to those obtainable with the fluoroborate treatment of the prior art. It is also apparent from this data that detrimental affects occur when the surface is rinsed or wiped dry after the solution treatment and before heat treatment.

EXAMPLE 2

The next step was to determine, if ferric chloride worked, why not other iron salts. As may be seen in Table No. 2, the iron salts used tended to improve the HTO condition as measured by C.E.J. Glossmeter quotient values. However, even with comparable pH levels and longer immersion times, the other iron salts do not produce the high results obtained with ferric chloride.

These results should not be taken to mean that no other iron salt compound exists which offers the improvement of ferric chloride. The other salts tried were available in the lab and were used to see if iron salts in general would work satisfactorily.

TABLE NO. 1

C.E.J. GLOSSMETER QUOTIENT RESULTS BRIGHT DIP ONLY

| Concentration Wt. % | pH | Immersion Time 1 sec. | 5 sec. | 30 sec. | 60 sec. | 5 min. | Spray |
|---|---|---|---|---|---|---|---|
| 1% | 1.8 | — | 86 | 84 | 94 | — | 91 |
| 3% | 1.5 | — | 94 | 94 | 92 | — | 93 |

TABLE NO. 1-continued

C.E.J. GLOSSMETER QUOTIENT RESULTS BRIGHT DIP ONLY

| Concentration Wt. % | pH | Immersion Time 1 sec. | 5 sec. | 30 sec. | 60 sec. | 5 min. | Spray |
|---|---|---|---|---|---|---|---|
| 10% | 1.0 | — | 95 | 96 | 97 | — | 95 |
| 20% | .8 | 93 | 92 | 92 | — | — | — |
| HCl (0.37% by wt.) | 1.0 | — | — | — | 76 | 72 | — |
| Control S.H.T. As-Received | | | | | | 63 | |
| Control S.H.T. $NH_4BF_4$ | | | | | | 96 | |
| 10% - 30-sec. dip then blow dry. | | | | | | 95 | |
| 10% - 30 sec. dip then D.I. rinse | | | | | | 81 | |
| 10% - 30 sec. dip then D.I. rinse and nitric dip. | | | | | | 84 | |
| 10% - 30 sec. dip then squeegee dry. | | | | | | 89 | |
| 10% - Roller applied then squeegee dry. | | | | | | 82 | |

TABLE NO. 2

IRON SALTS
C.E.J. GLOSSMETER QUOTIENT RESULTS BRIGHT DIP ONLY

| Solution* | | | | Comments |
|---|---|---|---|---|
| Ferric Chloride | $FeCl_3.6H_2O$ | 94 | (1 Min. Immersion) | Slight Visible Reaction |
| Ferrous Chloride | $FeCl_2.2H_2O$ | 90 | (5 Min. Immersion) | Slight Visible Reaction |
| Ferric Sulfate | $Fe_2(SO_4)_3.XH_2O$ | 83 | (5 Min. Immersion) | Slight Visible Reaction |
| Ferrous Sulfate | $FeSO_4.nH_2O$ | 75 | (5 Min. Immersion) | Slight Visible Reaction |
| Ferric Nitrate | $Fe(NO_3)_3.9H_2O$ | 80 | (5 Min. Immersion) | No Visible Reaction |
| Ferric Ammonium Oxalate | | 80 | (5 Min. Immersion) | No Visible Reaction |
| Average Control (7 Readings) S.H.T. As Received | | 64 | | |
| Fluoroborate Control (3 Samples) | | 92 | | |

*All concentrations are 10% by weight with pH adjusted to 1.0 with the complimentary acid. .1 Vol. % of surfactant added. Samples were ambient dried with no rinse.

TABLE NO. 3

OTHER TREATMENTS
C.E.J. GLOSSMETER QUOTIENT RESULTS BRIGHT DIP ONLY

| Solution | Concentration in $H_2O$ | pH | Immersion | Quotient | Comments |
|---|---|---|---|---|---|
| $ZnCl_2$ | 10% | 1.0 | 5 Min. | 95 | Mild reaction |
| $ZnCl_2$ + $NaPO_3$ | 10% 3% | 1.0 | 5 Min. | 89 | Mild reaction |
| $NiCl_2.6H_2O$ + | 1% | 1.0 | 5 Min. | 90 | No visible reaction |
| $NiCl_2.6H_2O$ + $NaPO_3$ | 5% | 1.0 | 5 Min. | 93 | Mild reaction |
| $NICl_2$ + $NaPO_3$ | 3% 1% | 1.1 | 60 Sec. | 93 | Vigorous reaction |
| $CUCl_2$ | 10% | 1.0 | 90 Sec. | 93 | Very vigorous reaction |
| $CoCl_2.6H_2O$ | 10% | 1.0 | 5 Min. | 94 | Slightly visible reaction |
| $MgCl_2$ | 10% | 1.0 | 5 Min. | 62 | No visible reaction |
| $FeCl_3.6H_2O$ + $NiCl_2.6H_2O$ | 3% 1% | 1.0 | 30 Sec. | 92 | Mild reaction |
| $FeCl_3.6H_2O$ + $NiCl_2.6H_2O$ + | 3% 2% | 1.0 | 30 Sec. | 94 | Mild reaction |
| HCl | 13% | — | 60 Sec. | 92 | Very vigorous reaction |
| Control S.H.T. As-Received | — | — | — | 81 | |

EXAMPLE 3

In an attempt to determine the effectiveness of other metal chlorides, aluminum samples were treated with a variety of other metal chlorides. As the results presented in Table No. 3 demonstrate, other metal chlorides offer substantial improvement in HTO control.

It should be noted that in comparing the data of the various tables that the results shown in Table III where a 13% HCl solution was used as a control and an acceptable glossmeter value obtained that this result is actually the effect of etching of the aluminum surface by the HCl. To support this finding, it is noted that measurements made of the aluminum surface after treatment with 13% HCl showed removal of aluminum therefrom at a rate of about $1.7\times10^{-2}$ g/cm$^2$. Similar evaluation of surface treated with iron chloride as reported in Table No. 1 and a 0.37% solution of HCl as also reported in Table No. 1 demonstrated surface removal (i.e. etching) of $6.1\times10^{-5}$ gm/cm$^2$ and $1.2\times10^{-5}$ gm/cm$^2$ respectively. This low concentration HCl solution showed substantially lower glossmeter readings. It is thus apparent that the mechanism by which the transition metal chlorides achieve their desirable results is not by etching of the aluminum surface.

From the foregoing it is apparent that we have discovered a simple, inexpensive, and environmentally safer process for the control of HTO in aluminum sheet material which is prone to this problem.

Although the process has been described with reference to specific embodiments, the useful scope of the invention is intended to be limited only by the appended claims.

We claim:

1. A method for the control of high temperature oxidation in aluminum materials to be subjected to solution heat treatment consisting of exposing the surface of the aluminum material to an aqueous solution consisting of a transition metal chloride prior to said solution heat treatment.

2. The method of claim 1 wherein the metal portion of the transition metal chloride is selected from the group consisting of iron, zinc, nickel, copper, and cobalt.

3. The method of claim 1 wherein the transition metal chloride comprises ferric chloride.

4. The method of claim 1 wherein the pH of the aqueous solution ranges between about 0.5 and about 2.

5. The method of claim 4 wherein the pH of the aqueous solution ranges between about 1 and about 1.5.

6. The method of claim 1 wherein the treatment time ranges from about 5 to about 300 seconds.

7. The method of claim 1 wherein the concentration of total transition metal chloride in the aqueous solution ranges from about 0.5 to about 25% by weight.

8. The method of claim 7 wherein concentration of a transition metal chloride in the aqueous solution ranges from about 3 to about 10% by weight.

9. A method for the control of high temperature oxidation in aluminum materials to be subjected to solution heat treatment consisting of exposing the surface of the aluminum material for a period of between about 5 and about 300 seconds, to an aqueous solution consisting of from about 0.5 to about 25% by weight of a transition metal chloride; and having a pH between about 0.5 and about 2, without wiping or rinsing, prior to the heat treatment.

10. The method of claim 9 wherein the transition metal chloride is selected from the group consisting of chlorides of iron, zinc, nickel, copper, and cobalt.

11. The method of claim 10 wherein the transition metal chloride is ferric chloride.

12. The method of claim 11 wherein the transition metal chloride concentration is between about 3 and about 10% by weight and the pH of the solution is between about 1 and 1.5.

* * * * *